US011495197B2

(12) United States Patent
Jacobs et al.

(10) Patent No.: US 11,495,197 B2
(45) Date of Patent: Nov. 8, 2022

(54) MUSICAL INSTRUMENTS CONFIGURED TO HELP REFINE PLAYING TECHNIQUE, AND METHOD OF MAKING SAME

(71) Applicant: JERSEY SURF, INC., West Berlin, NJ (US)

(72) Inventors: Robert Jacobs, West Berlin, NJ (US); Richard Klimowicz, West Berlin, NJ (US)

(73) Assignee: JERSEY SURF, INC., West Berlin, NJ (US)

( * ) Notice: Subject to any disclaimer, the term of this patent is extended or adjusted under 35 U.S.C. 154(b) by 0 days.

(21) Appl. No.: 17/806,970

(22) Filed: Jun. 15, 2022

(65) Prior Publication Data

US 2022/0310043 A1 Sep. 29, 2022

Related U.S. Application Data

(63) Continuation of application No. PCT/US2022/070110, filed on Jan. 10, 2022.

(Continued)

(51) Int. Cl.
*G10D 13/08* (2020.01)
*G10D 13/03* (2020.01)

(Continued)

(52) U.S. Cl.
CPC ..... *G10D 13/03* (2020.02); *G10D 13/08* (2013.01); *G10D 13/14* (2020.02); *G10D 13/24* (2020.02)

(58) Field of Classification Search
CPC ..... G10D 13/03; G10D 13/14; G10D 13/24; G10D 13/08
See application file for complete search history.

(56) References Cited

U.S. PATENT DOCUMENTS 489,035 A * 1/1893 Rand ..... G10D 13/08 84/408
674,604 A * 5/1901 Deagan ..... G10D 13/08 84/403

(Continued)

FOREIGN PATENT DOCUMENTS

JP 2002156964 A 5/2002

OTHER PUBLICATIONS

International Search Report of PCT/US2022/070110 dated Apr. 1, 2022.

(Continued)

*Primary Examiner* — Robert W Horn
(74) *Attorney, Agent, or Firm* — Mark T. Vogelbacker; Eckert Seamans Cherin & Mellott, LLC

(57) ABSTRACT

A practice musical instrument configured to mimic implement rebound produced when playing a conventional version of the musical instrument can include a plurality of spaced-apart, rectangular keys. At least two of the keys can have a different length. A strike pad can be attached to a top surface of each key. Each strike pad can be formed of rubber. Each strike pad can be sized to the key to which it is attached. Hitting one of the strike pads with an implement can produce a rebound of the implement that mimics a rebound of the implement when hitting a corresponding key of the conventional version of the instrument. Hitting one of the strike pads with the implement produces a sound that is quieter than when the implement hits a corresponding key of the conventional version of the instrument.

20 Claims, 7 Drawing Sheets

Related U.S. Application Data

(60) Provisional application No. 63/135,784, filed on Jan. 11, 2021.

(51) Int. Cl.
*G10D 13/24* (2020.01)
*G10D 13/14* (2020.01)

(56) References Cited

U.S. PATENT DOCUMENTS

| | | | | | |
|---|---|---|---|---|---|
| 870,092 | A * | 11/1907 | Gay | G10D 13/08 | 84/408 |
| 2,133,712 | A * | 10/1938 | Musser | G10D 13/08 | 984/155 |
| 2,194,545 | A * | 3/1940 | Firestone | G10D 13/08 | 984/155 |
| 2,484,745 | A * | 10/1949 | Rowe | G10K 1/067 | 84/405 |
| 3,595,119 | A * | 7/1971 | Kuijpers | G10D 13/08 | 984/155 |
| 3,776,091 | A | 12/1973 | Suzuki | | |
| 4,237,767 | A * | 12/1980 | Levine | G10D 13/08 | 984/155 |
| 5,492,047 | A | 2/1996 | Oliveri | | |
| 11,127,384 | B1 * | 9/2021 | Fugate | G10D 13/08 | |
| 11,132,985 | B2 * | 9/2021 | Howe | G10H 3/146 | |
| 2006/0180003 | A1 * | 8/2006 | Swinkels | G10D 13/08 | 84/402 |
| 2022/0180846 | A1 * | 6/2022 | Wernick | G10D 13/14 | |

OTHER PUBLICATIONS

Written Opinion of the International Search Authority of PCT/US2022/070110 dated Apr. 1, 2022.

* cited by examiner

MUSICAL INSTRUMENTS CONFIGURED TO HELP REFINE PLAYING TECHNIQUE, AND METHOD OF MAKING SAME

CROSS-REFERENCE TO RELATED APPLICATION

The present application is a Continuation of International Application No. PCT/US2022/070110, filed Jan. 10, 2022, which claims priority to U.S. Provisional Patent Application No. 63/135,784, titled "MUSICAL INSTRUMENTS CONFIGURED TO HELP REFINE PLAYING TECHNIQUE, AND METHOD OF MAKING SAME" and filed Jan. 11, 2021, the disclosure of each is hereby incorporated by reference in their entirety.

FIELD

The presently disclosed technology relates to music and musical instruments.

More particularly, in one embodiment, the presently disclosed technology relates to creating a practice, teaching, or learning musical instrument that is less expensive, optionally smaller, and/or optionally lighter than an authentic or "real" counterpart, without sacrificing the feel (e.g., physical touch, sensation, and/or feedback) of playing the authentic counterpart. In another embodiment, the presently disclosed technology relates to a full-size, foldable or compactable musical instrument that produces or mimics the touch or feel (e.g., simulates the rebound or bounce) of playing a traditional musical instrument.

BACKGROUND AND DESCRIPTION OF RELATED ART

It is challenging for aspiring or young musicians, percussionists, and/or instructors to practice playing certain musical instruments due to the high cost and/or large size of true concert performance instruments, such as, but not limited to, marimbas and vibraphones.

Marimbas are typically made from exotic (and rare) rosewood, or utilize synthetic (e.g., fiberglass-based) keys in outdoor settings, such as in marching bands. Vibraphones typically have metallic keys. Authentic or "real" marimbas and vibraphones sell for thousands of dollars (e.g., $15,000-$20,000) and are physically very large instruments. These instruments are often cost prohibitive. For example, most high school and college student percussion majors do not own their own instruments.

Various strategies and devices are known in the art to attempt to make learning or perfecting the art of playing a musical instrument easier and less expensive. While these known practice instruments have certain advantages, each also has disadvantages.

To reduce costs, conventional practice marimbas typically use a rosewood proxy (such as padauk) to make the keys. The result is a viable practice instrument that would not be suitable on the concert stage or recording studio due to the less-than-ideal sound quality produced. While these practice marimbas are less expensive (e.g., $3,000-$3,500) than the authentic instrument, they are still cost prohibitive.

Other known practice instruments are generally rectangular, but without graduated keys. This does not provide a realistic performance environment. These prior art instruments are sufficient for "going through the motions," but are not helpful in refining performance technique. As a result, such prior art devices have limited utility for the serious performer.

Beetle Percussion of Olathe, Kansas makes hand crafted percussion instruments and practice pads. A downside of these practice products is that they do not graduate to the scale of a full size instrument. In addition, the accidentals do not hang over the natural keys, so learning to play some styles of music, like chromatic scales and fast blues scales or chords, results in the user missing the natural feel of the secondary playing zones.

Some prior art practice instruments print a graphic on a keyboard. One drawback of this type of device is that it does not and cannot simulate the rebound of a conventional instrument.

BRIEF SUMMARY

There is a need to create a practice instrument that is affordable and simulates the playing experience of a real instrument. There is also a need to create a quieter practice instrument. In addition, there is a need to create a full-scale musical instrument that is easily foldable or collapsible for travel and/or storage. The above and other needs are addressed by the presently disclosed technology.

Much of the educational process for a beginner or student musician is focused on fundamentals and mechanics as a precursor to sound quality. The presently disclosed technology provides everything students or novices need to develop their skills to that end. Once the students or novices "develop their chops" by practicing with the presently disclosed technology, the finishing touch is to take their skills to the studio or rehearsal hall to focus on the musicality.

In one aspect, the presently disclosed technology is directed to an apparatus and method that focuses on creating an accurate, simulated environment that gives the player nearly all of the same characteristics of being on a real version of the instrument, without producing the authentic sound.

In another aspect, the practice or simulated instruments of the presently disclosed technology will not resonate melodically, but will enable the performer to use proper technique (e.g., implement placement and/or speed), and work on all of the other skills necessary to learn and rehearse their musical literature without the need for the large financial investment or physical space considerations required by the authentic or "real" musical instrument.

Optionally, in one embodiment, the point of the presently disclosed technology is not to make sound, but rather to use as a tool in the refinement of technique, such as hand placement, implement placement, and/or the physical range of motion involved in proper performance technique. Since there is no need to worry about the acoustic qualities of the instrument, the presently disclosed technology is geared to the physical and/or rhythmic aspects of performance and not the melodic. Students will learn the music on the instrument of the presently disclosed technology and will refine the sound of their performance in the practice room or rehearsal studio.

In another aspect, the presently disclosed technology creates a reasonably priced range of products that will enable students to have a more meaningful home practice experience.

In one optional embodiment, the presently disclosed technology is manufactured largely or entirely from recycled materials. Optionally, the instrument can be made from new or used wood pallets and tires.

In one optional embodiment, the presently disclosed technology is directed to a musical instrument that includes a plurality of spaced-apart, rectangular keys and a strike pad attached to a top surface of each key. Each strike pad is optionally formed of rubber. Each strike pad is sized to the key to which it is attached.

In one optional embodiment, the presently disclosed technology is directed to a musical instrument that includes a plurality of spaced-apart, rectangular keys that are arranged in two rows. A first row of the two rows is positioned vertically above and horizontally offset from a second row of the two rows. A first spacing having a first dimension is located between at least two laterally adjacent keys in the first row. A second spacing having a second dimension is located between every other or every third set of keys in the first row. The second dimension is greater than the first dimension. The keys in the second row are equidistantly spaced-apart across a width of the musical instrument. Each key is formed of one of metal, wood, or a synthetic material. A strike pad is glued to a top surface of each key. Each strike pad is optionally formed of rubber. Each strike pad can have a rectangular shape. A length of each strike pad is slightly less than a length of the key to which it is attached. A width of each strike pad is slightly less than a width of the key to which it is attached.

Optionally, the instrument can be foldable or collapsible for each of travel and/or storage.

BRIEF DESCRIPTION OF THE DRAWINGS

The foregoing summary, as well as the following detailed description of the presently disclosed technology, will be better understood when read in conjunction with the appended drawings, wherein like numerals designate like elements throughout. For the purpose of illustrating the presently disclosed technology, there are shown in the drawings various illustrative embodiments. It should be understood, however, that the presently disclosed technology is not limited to the precise arrangements and instrumentalities shown. In the drawings.

DETAILED DESCRIPTION

Figure 1:
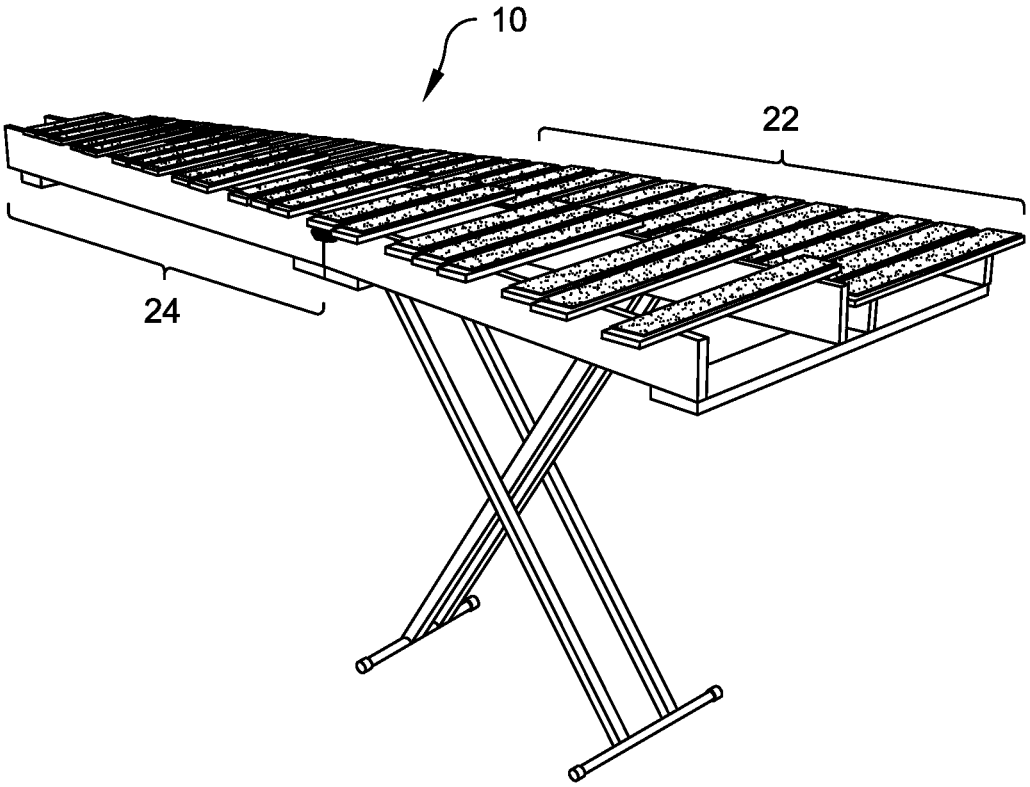
FIG. 1 is a perspective view of a practice musical instrument according to an embodiment of the presently disclosed technology, wherein the instrument is shown in a first, expanded, or playing configuration.

While systems, devices and methods are described herein by way of examples and embodiments, those skilled in the art recognize that the presently disclosed technology is not limited to the embodiments or drawings described. Rather, the presently disclosed technology covers all modifications, equivalents and alternatives falling within the spirit and scope of the appended claims. Features of any one embodiment disclosed herein can be omitted or incorporated into another embodiment.

Any headings used herein are for organizational purposes only and are not meant to limit the scope of the description or the claims. As used herein, the word "may" is used in a permissive sense (i.e., meaning having the potential to) rather than the mandatory sense (i.e., meaning must). Unless specifically set forth herein, the terms "a," "an" and "the" are not limited to one element but instead should be read as meaning "at least one." The terminology includes the words noted above, derivatives thereof and words of similar import.

Referring now in detail to the various figures, wherein like reference numerals refer to like parts throughout, FIGS. 1-7 illustrate a practice, teaching, or learning musical instrument, generally designated 10, according to the presently disclosed technology. As explained below, the instrument 10 is designed to assist a user in refining playing technique (e.g., at least one or more of hand placement, implement placement, physical range of motion, etc.), not necessarily in producing, or instead of producing, a sound or melody consistent with playing an authentic, traditional, convention, or "real" counterpart musical instrument. As a result, the instrument 10 can be considered a "practice" instrument.

Figure 2:
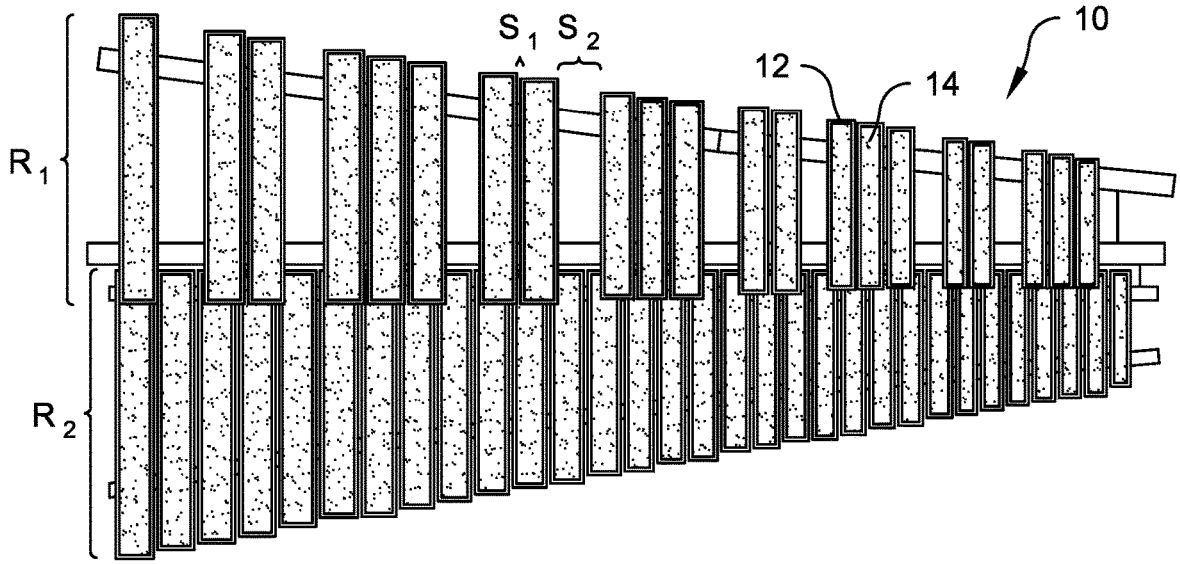
FIG. 2 is a top plan view of the instrument shown in FIG. 1.

As shown in FIGS. 1 and 2, the instrument 10 can include a plurality of spaced-apart note bars, tone plates, or keys 12. Optionally, the keys 12 can be graduated and/or arranged in two or more rows. As shown in FIG. 2, in one optional embodiment, adjacent keys 12 can have the same width, but a different length. In another optional embodiment, the width of the keys can vary (e.g., to mimic the graduated tone bars of certain conventional instruments). Each key 12 can have a rectangular shape when viewed from above. However, the keys 12 are not limited to the size, shape, and/or configuration as shown and described herein. Each key 12 can be formed of one of metal, wood, or a synthetic material. Optionally, the keys 12 can be formed from recycling old fork lift pallets into a practice musical instrument.

In any embodiment, as shown in FIGS. 1 and 2, a first row $R_1$ of the two rows of keys 12 can be positioned vertically above (e.g., higher or further from the ground surface) and horizontally off-set (e.g., further away from where the user would stand) from a second row $R_2$ of the two rows. For example, as shown in FIGS. 1 and 2, the second row $R_2$ is deeper into the image than the first row $R_1$. Also, the first $R_1$ is closer to the top of the image than the second row $R_2$. However, the instrument 10 is not limited to more than one row of keys 12, as a single row of keys 12 could be beneficial depending upon the user and the purpose.

In the illustrated embodiment, a first spacing $S_1$ having a first dimension is located between at least two laterally adjacent keys 12 in the first row $R_1$. A second spacing $S_2$ having a second dimension is located between every other or every third set of keys 12 in the first row $S_1$. The second dimension can be greater than the first dimension, such as by two or more times. The keys 12 in the second row $R_2$ can be equidistantly spaced-apart across a width of the instrument 10, for example with the first spacing $S_1$ between each adjacent pair of key 12. Of course, the keys 12 can have a different arrangement and/or configuration from that shown and described herein.

Figure 8:
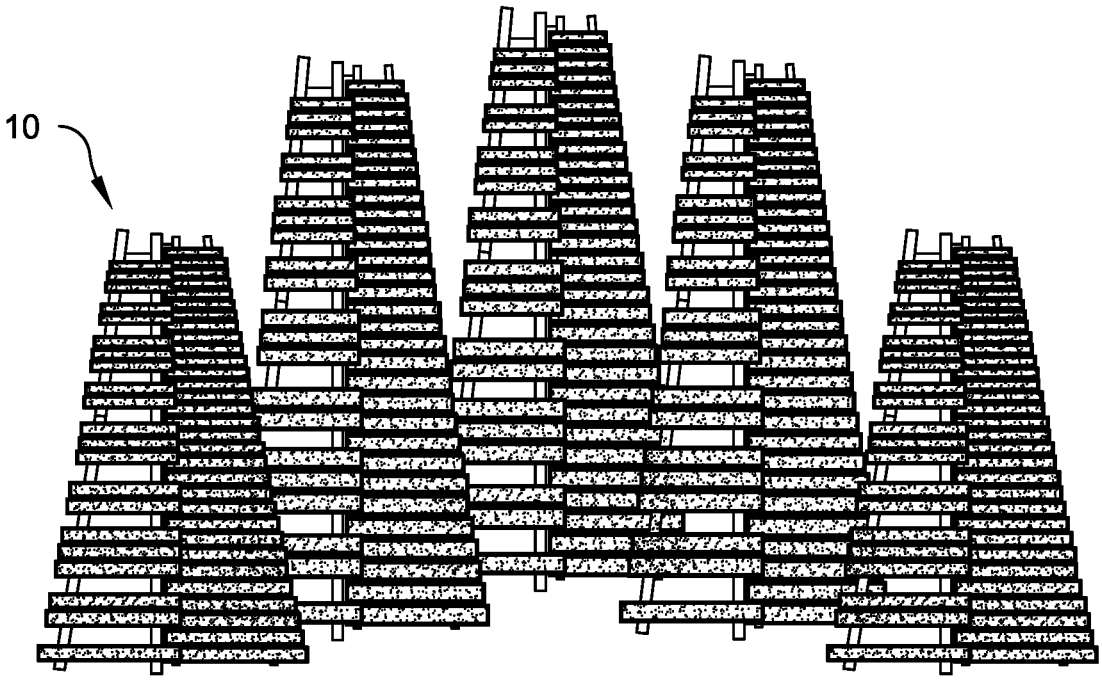
FIG. 8 is a perspective view of various instruments according to an embodiment of the presently disclosed technology.

Optionally, the instrument 10 can be a marimba. The instrument can optionally be a 4.3, 4.6, or 5.0 octave marimba. FIG. 8 shows marimbas of the presently disclosed technology of various size. However, the instrument 10 is not limited to being a marimba, but can be any other musical instrument (e.g., but not limited to, a vibraphone, a xylophone, other keyboard instruments, concert bells, concert glockenspiels, and the like, such as any padded manufactured keys designed to be struck by an implement) that can benefit from the technology or techniques described herein.

In an optional embodiment, the keys 12 are movable or reconfigurable by the user to create different configurations to create different versions of the instrument 10.

In an authentic or traditional version of the instrument 10, the keys would normally be struck when playing to produce a particular sound, and the harder the keys are hit the loader and/or sharper the sound that is produced. This is not the case in at least one embodiment of the presently disclosed technology. The instrument 10 of the presently disclosed technology is designed to produce little or any sound, while also mimicking the implement rebound that is produced when playing a conventional version of the musical instrument. This can be beneficial when attempting to practice or play music in an environment where loud noises are unwelcomed (e.g., in a dormitory room late at night), or when the student or player is inexperienced and is not yet able to produce appeasing music.

Figure 3:
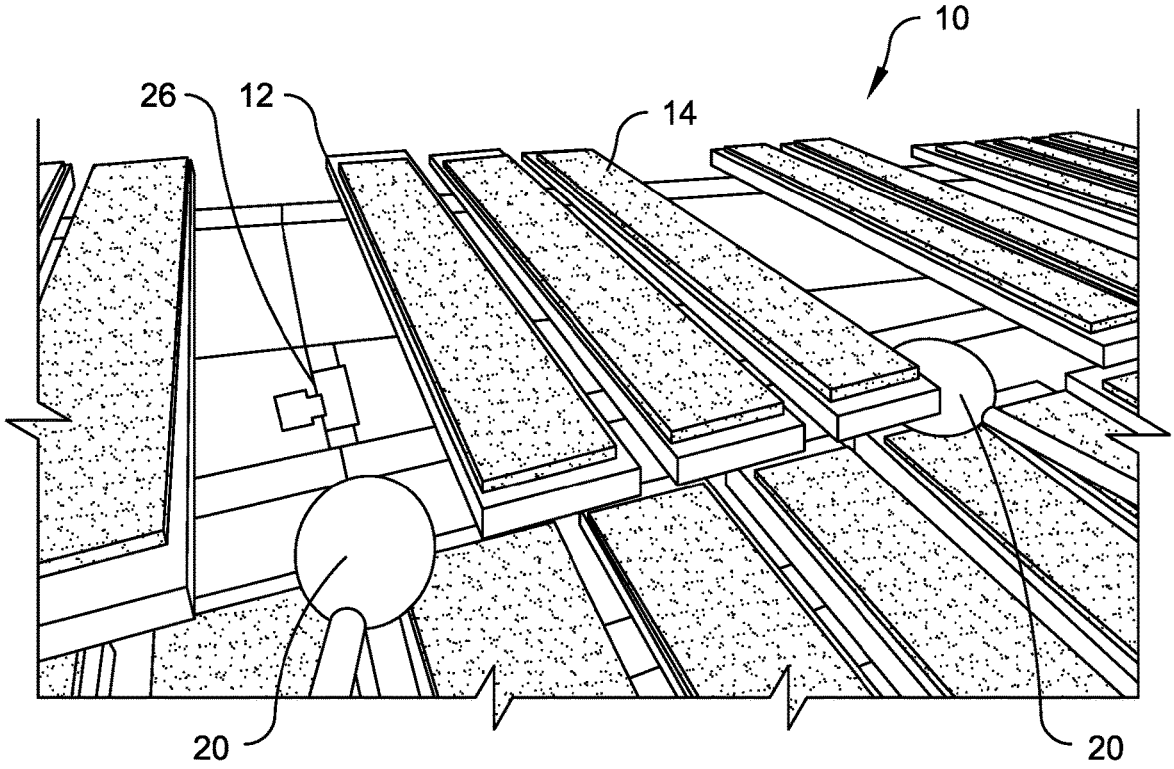
FIG. 3 is a magnified perspective view of a portion of the instrument shown in FIG. 1, wherein a portion of two implements are shown.

As shown in FIGS. 1-3, 5 and 6, a strike pad 14 can be fastened or otherwise fixed, such as by, but not limited to, adhesive or glue, a tongue-and-groove arrangement wherein each strike pad 14 is slid or pivoted into a channel, one or more fasteners (e.g., a pin, a nail, or a srew), and/or by heat, for example, to a top surface of each key 12. Each surface of the strike pad 14 can be flat, planar, or generally planar. Optionally, a top surface of one or more or each strike pad 14 has a slightly convex shape. The top surface of the strike pad 14 is configured to be struck or hit by an implement 20 (e.g., a mallet), for example, as shown in FIG. 3. Each strike pad 14 can have a rectangular shape and/or a shape that matches the shape of the key 12 to which it is attached. For example, each strike pad 14 can have a length and a width that is equal to or at least slightly less than a length and a width of the key 12 to which it is attached.

Each strike pad 14 is configured to minimize, dampen, or prevent any sound produced by the respective key 12, while simulating native mechanical characteristics of the key or instrument (e.g., not too hard or too soft), minus the resonance of a tuned set of keys. Each strike pad 14 can optionally be formed of a natural or synthetic rubber, such as rubber recycled from old tires or from rolls of gum rubber. The rubber provides a realistic "rebound" to the implement, and also makes the impact between the implement and the key 12 silent or nearly silent. For example, one such material is neoprene, which is relatively light in weight and inexpensive. Other materials with the same or similar qualities may also be used. Each strike pad 14 is not limited to a particular type of material, as long as the material is capable of not producing a sound (or producing a negligible sound) when struck, while mimicking the rebound or bounce of a conventional key when struck. This will enable the instrument to be used in various non-conventional environments, for example a bedroom, apartment or dorm room, without creating the sound that would be a function of playing a real instrument.

As shown in FIG. 2, in one optional embodiment, adjacent strike pads 14 can have the same width, but a different length. In another optional embodiment, a width of each strike pads 14 can depend upon the key to which it is attached. Optionally, a length of each strike pad 14 is more than several (e.g., ten) times a thickness of each strike pad 14.

Optionally, a length of each strike pad 14 is more than several (e.g., three) times a width of each strike pad 14. In one example, any of the dimensions of each strike pad 14 is based on availability of materials in a given production lot. For example, when using gum rubber strike pads, the thickness may be less than it would be when making strike pads made from neoprene or a more "open-celled" rubber or rubber-like material.

Each strike pad 14 can be sized to the key 12 to which it is attached, such that each key 12 can include a correspondingly-sized strike pad 14. For example, a length of each strike pad 14 can be the same as or slightly less than a length of the key 12 to which it is attached. A width of each strike pad 14 can be the same as or slightly less than a width of the key 12 to which it is attached.

Figure 6:
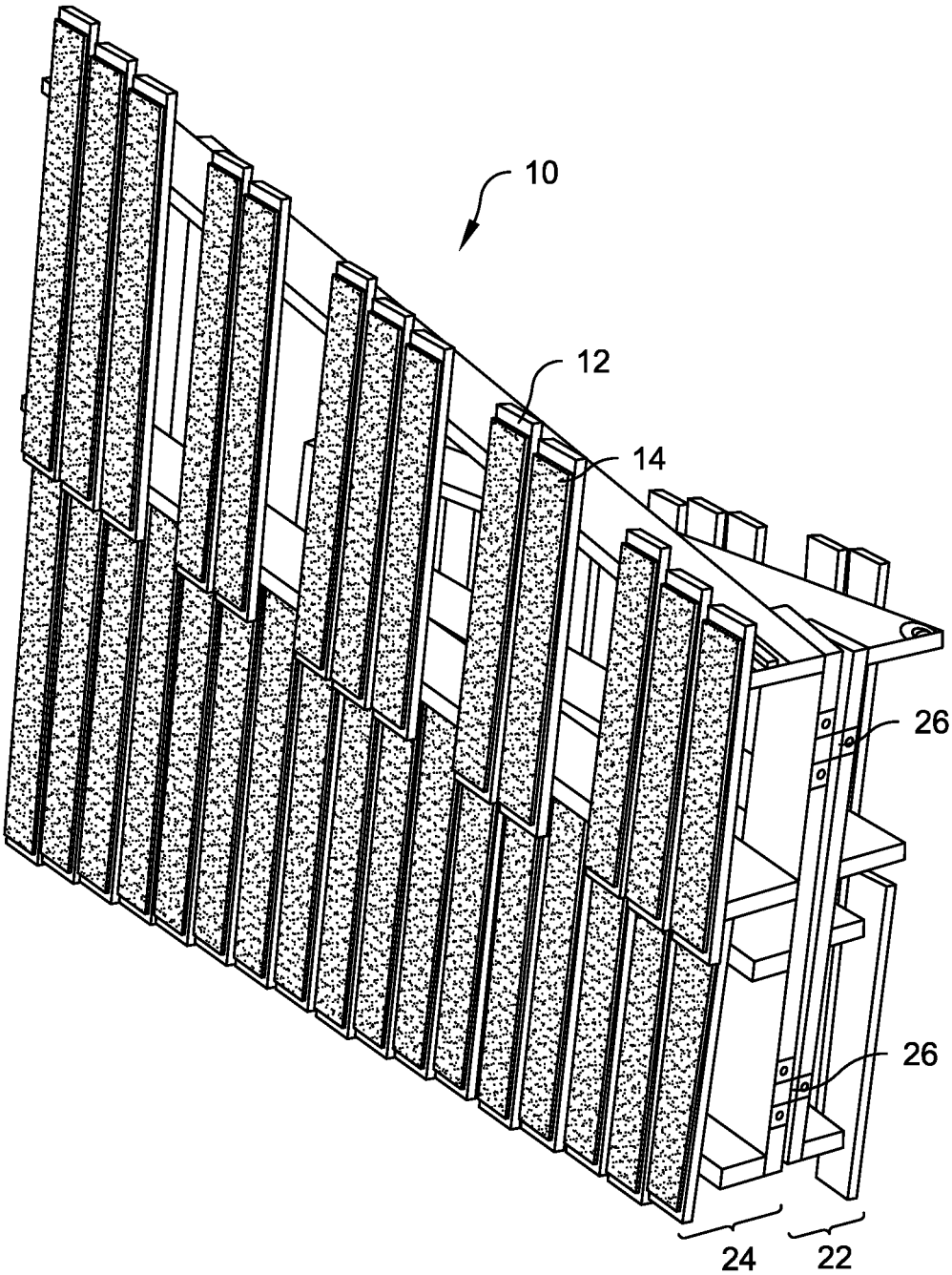
FIG. 6 is a perspective view of the instrument shown in FIG. 1, wherein the instrument is shown in the second, collapsed, or travel configuration.

One of several benefits of the presently disclosed technology is that the instrument 10 can optionally fold or collapse for ease of transport of storage. Conventional musical instruments are often large and/or bulky, which discourages or prevents practicing, and makes storage and transportation difficult. In one embodiment of the presently disclosed technology, the instrument 10 can include a first portion 22 attached to a second portion 24 by at least one or two or more hinges 26. As shown in FIGS. 1 and 2, the hinge(s) 26 can be configured to orient the first portion 22 in a single plane with the second portion 24, such that the instrument 10 has an overall length that is the same as the conventional version of the instrument. As shown in FIG. 6, the hinge(s) 26 can be configured to orient the first portion 22 parallel to the second portion 24 in two separate planes such that the instrument 10 is approximately half the overall length of the conventional version of the instrument 10. This is helpful for storing the instrument 10 in small or tight spaces (e.g., a closet).

Optionally, the at least one hinge 26 can be two spaced-apart hinges, such as shown in FIG. 6. The two hinges 26 can extend along a single axis, which can be parallel to a longitudinal axis of each of the keys 12.

Figure 4:
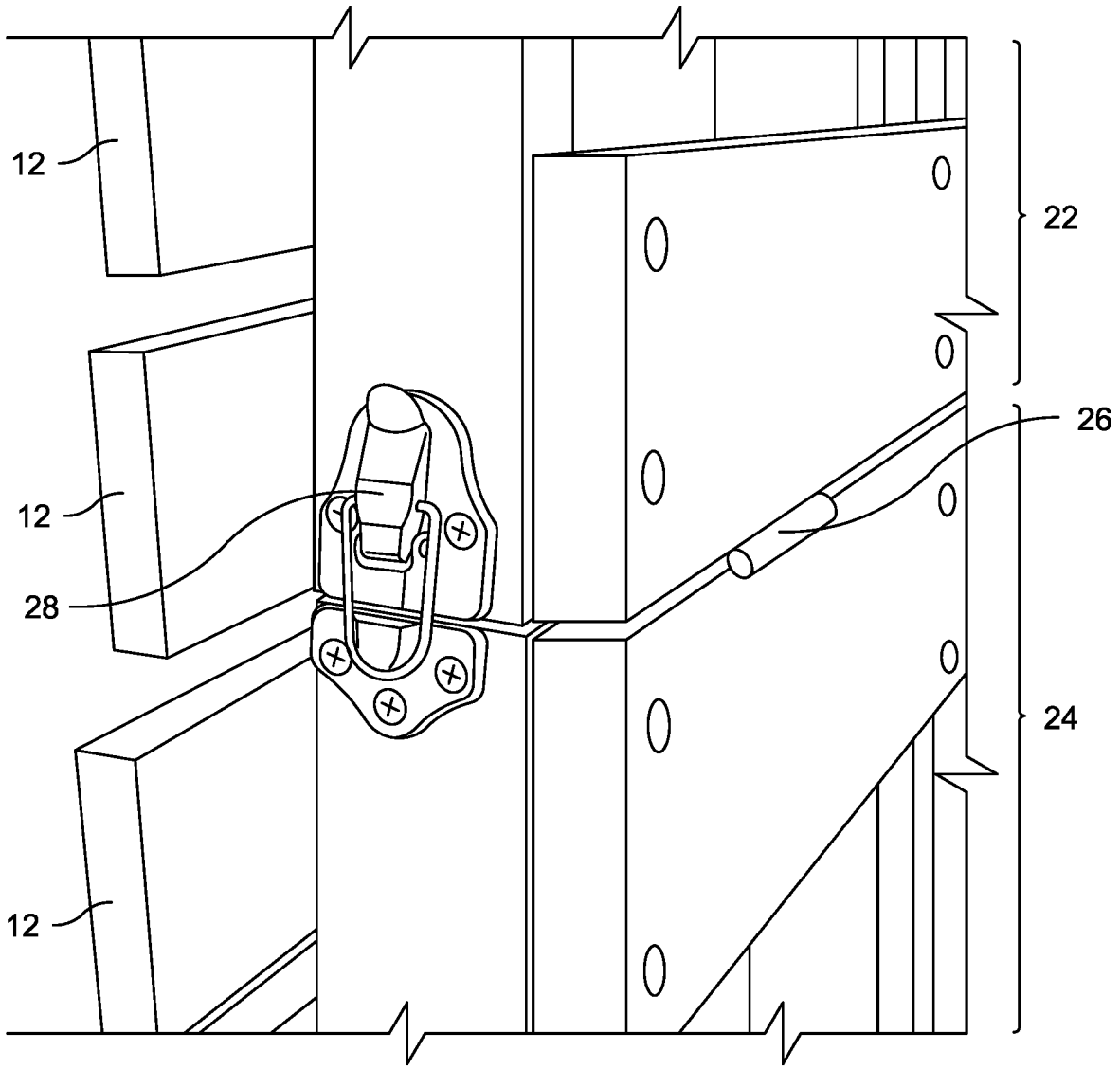
FIG. 4 is a magnified perspective view of a portion of the instrument shown in FIG. 1.
Figure 5:
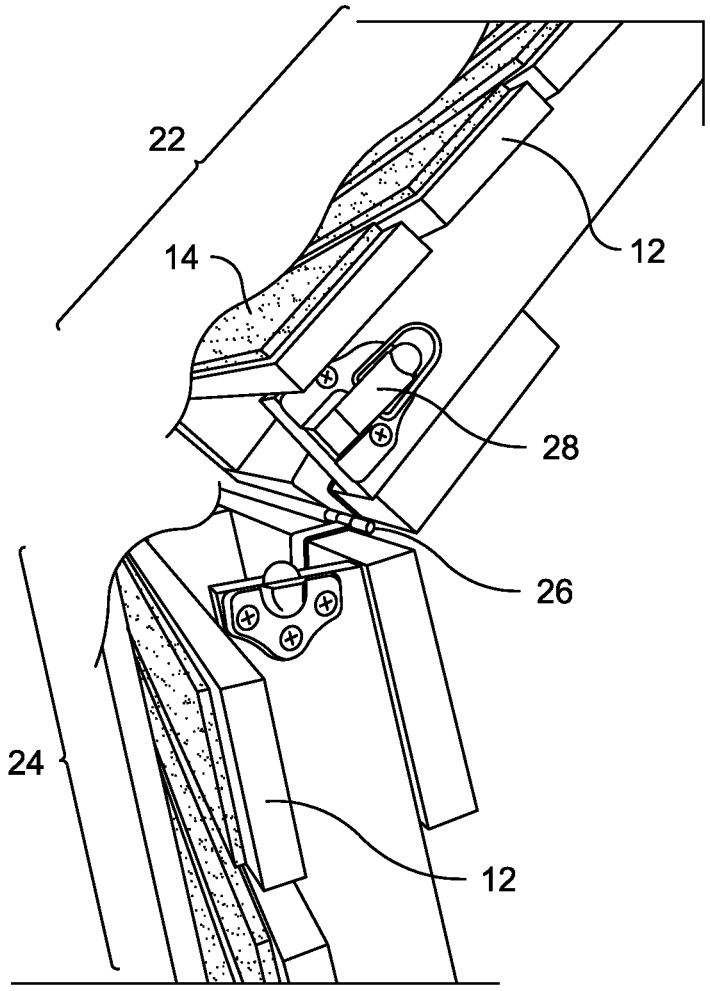
FIG. 5 is a magnified perspective view of a portion of the instruments shown in FIG. 1, wherein the instrument is shown in a second, collapsed, or travel configuration.
Figure 7:
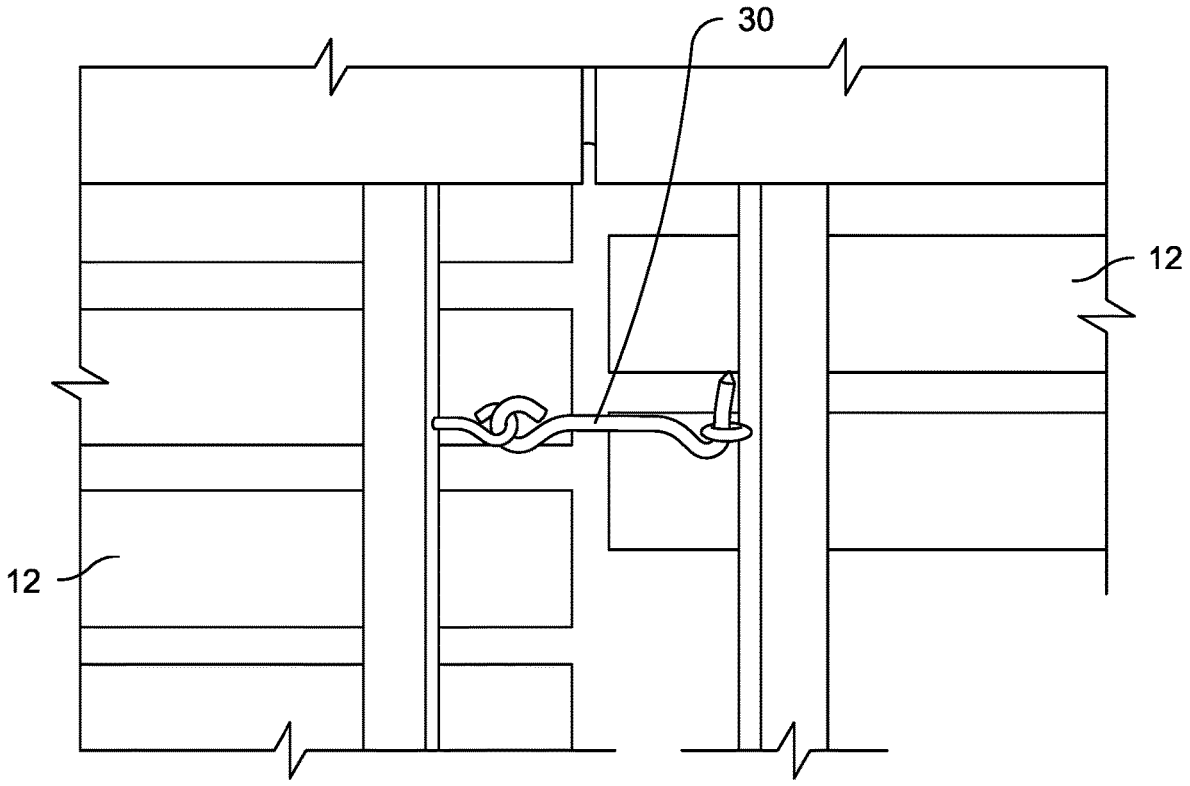
FIG. 7 is a magnified plan view of a portion of the instrument shown in FIG. 6.

The instrument 10 can optionally include one or more fasteners to hold or maintain the instrument 10 in the unfolded configuration (e.g., see FIGS. 1-4) and/or the folded configuration (e.g., see FIGS. 6 and 7). As shown in FIGS. 4 and 5, the one or more fasteners can be at least one over-the-center latch 28. The over-the-center latch 28 can be located on an exterior or side surface of the instrument, optionally beneath one or more of the keys 12. The over-the-center latch 28 can be configured to maintain the instrument 10 in the unfolded or playing configuration. As shown in FIG. 6, an additional or alternative fastener can be at least one eye hook 30. The eye hook 30 can be located on an internal or underneath surface of the instrument 10. The eye hook 30 can be configured to maintain the instrument in the folded, transportation, or storage configuration.

One method of the presently disclosed technology includes fixing or gluing a strike pad 14, optionally formed of rubber, to a top surface of each of a plurality of spaced-apart (and optionally graduated or non-graduated) keys 12. Hitting one of the strike pads 14 with the implement 20 produces a rebound of the implement 20 that mimics a rebound of the implement 20 when hitting a corresponding key of the conventional version of the instrument 10. Hitting one of the strike pads 14 with the implement 20 produces no sound or a sound that is quieter than when the implement 20 hits a corresponding key of the conventional version of the instrument 10.

In an alternative embodiment, the strike pads 14 are sized and/or placed on the respective key 12 to form a strike zone. More particularly, the size of each strike pad 14 can be relative to the size of the note, and/or each strike pad 14 can be about half the length of the respective key 12. For example, one version includes fifty-three individual notes scaled to the size of a real musical key. As each note graduates in size to replicate the feel of a conventional version of the instrument, it will determine each note to have a different size strike pad 14 relative to the size of the note.

In such a configuration, the exact placement of each strike pad 14 on the respective key 12 is important. Optionally, there are two playing zones on the musical instrument. A first playing zone being the center of the bar and a second playing zone being on an edge of the accidentals (e.g., the top row). Each strike pad 14 can be sized, shaped, and/or configured to cover each or both playing zones of each key 12 to replicate the feel of the "real" instrument.

Optionally, the primary zones of the notes are the dead centers of the keys 12. The secondary playing zone of the accidentals is the edge of the key 12 right below the nodal point of the key. On the lower tier or row, the secondary zones are slightly off center in both directions, which is typically for professionals to use a less resonate tone for artistic purposes. So the strike pad 14 can be made large enough to cover enough of the respective key 12 to replicate that.

The following exemplary embodiments further describe optional aspects of the presently disclosed technology and are part of this Detailed Description. These exemplary embodiments are set forth in a format substantially akin to claims, although they are not technically claims of the present application. The following exemplary embodiments refer to each other in dependent relationships as "embodiments" instead of "claims."

1A. A musical instrument comprising a rubber strike pad fixed to a top surface of each key of a plurality of spaced-apart keys.

2A. The instrument of embodiment 1A, wherein the keys are graduated.

1B. A practice musical instrument comprising graduated keys formed of one of metal, wood, or a synthetic material and including a rubber strike pad fixed to a top surface of each of the graduated keys.

2B. The instrument of embodiment 1B, wherein each strike pad occupies about or less than half of the entire top surface of the respective key.

3A. A plurality of strike pads for a practice musical instrument, each strike pad being attached to a key, the strike pad being configured to absorb sound and impact to simulate native mechanical characteristics of the instrument, without the resonance of a tuned set of keys.

While the presently disclosed technology has been described in detail and with reference to specific examples thereof, it will be apparent to one skilled in the art that various changes and modifications can be made therein without departing from the spirit and scope thereof. It is understood, therefore, that the presently disclosed technology is not limited to the particular embodiments disclosed, but it is intended to cover modifications within the spirit and scope of the present presently disclosed technology as defined by the appended claims.

What is claimed is:

1. A practice musical instrument configured to mimic implement rebound produced when playing a conventional version of the musical instrument, the instrument comprising:

a plurality of spaced-apart, rectangular keys, at least two of the keys having a different length; and a strike pad attached to a top surface of each key, each strike pad being formed of rubber, each strike pad being sized to the key to which it is attached, wherein hitting one of the strike pads with an implement produces a rebound of the implement that mimics a rebound of the implement when hitting a corresponding key of the conventional version of the instrument, and wherein hitting one of the strike pads with the implement produces a sound that is quieter than when the implement hits a corresponding key of the conventional version of the instrument.

2. The instrument of claim 1, further comprising a first portion attached to a second portion by at least one hinge, the hinge being configured to orient the first portion in a single plane with the second portion such that the instrument has a overall length that is the same as the conventional version of the instrument, the hinge being configured to orient the first portion parallel to the second portion in two separate planes such that the instrument is approximately half the overall length of the conventional version of the instrument.

3. The instrument of claim 1, wherein each strike pad has a rectangular shape, and wherein each strike pad has a length and a width that is equal to or less than a length and a width of the key to which it is attached.

4. The instrument of claim 1, wherein adjacent strike pads have a different length, and wherein each of the strike pads has the same width.

5. The instrument of claim 4, wherein a length of each strike pad is slightly less than a length of the key to which it is attached.

6. The instrument of claim 4, wherein a width of each strike pad is slightly less than a width of the key to which it is attached.

7. The instrument of claim 1, wherein the instrument is a vibraphone and each key is formed of metal.

8. The instrument of claim 1, wherein the instrument is a marimbas and each key is formed of wood or a synthetic material.

9. The instrument of claim 1, wherein each strike pad is fixed to a top surface of the respective key with glue.

10. The instrument of claim 1, wherein a thickness of each strike pad is less than a thickness of the key to which the strike pad is attached.

11. The instrument of claim 1, wherein the plurality of spaced-apart keys are arranged in two rows, a first one of the two rows being positioned above and off-set from a second one of the two rows, the hinge being configured to permit the instrument to fold about an axis that extends parallel to a longitudinal axis of each key.

12. A practice musical instrument configured to mimic implement rebound produced when playing a conventional version of the musical instrument, the instrument comprising:

a plurality of spaced-apart, rectangular keys, at least two of the keys having a different length, the keys being arranged in two rows, a first row of the two rows being positioned vertically above and horizontally off-set from a second row of the two rows, each key being formed of one of metal, wood, or a synthetic material; and a strike pad glued to a top surface of each key, each strike pad being formed of rubber, each strike pad having a rectangular shape, a length of each strike pad being at least slightly less than a length of the key to which the strike pad is attached, a width of each strike pad being slightly less than a width of the key to which the strike pad is attached, wherein hitting one of the strike pads with an implement produces a rebound of the implement that mimics a rebound of the implement when hitting a corresponding key of the conventional version of the instrument, wherein hitting one of the strike pads with the implement produces a sound that is quieter than when the implement hits a corresponding key of the conventional version of the instrument, and wherein a first portion of the instrument is attached to a second portion of the instrument by at least one hinge, the hinge being configured to orient the first portion in a single plane with the second portion such that the instrument has a length that is the same as the conventional version of the instrument, the hinge being configured to orient the first portion parallel to the second portion in two separate planes such that the instrument is approximately half the length of the conventional version of the instrument.

13. The instrument of claim 12, wherein a length of each strike pad is more than ten times a thickness of each strike pad, and wherein the length of each strike pad is more than three times a width of each strike pad.

14. The instrument of claim 12, wherein the instrument is a vibraphone and each key is formed of metal.

15. The instrument of claim 12, wherein the instrument is a marimbas and each key is formed of wood or a synthetic material.

16. A method of making a practice musical instrument that is configured to mimic implement rebound produced when playing a conventional version of the musical instrument, the method comprising:

gluing a rubber strike pad to a top surface of each of a plurality of spaced-apart keys, at least two of the keys having a different length, wherein each strike pad is sized to the key to which it is attached.

17. The method of claim 16, further comprising:

folding the first portion with respect to the second portion about a hinge for storage or transporting of the instrument; and unfolding the first portion with respect to the second portion to practice on the instrument.

18. The method of claim 16, wherein each of the plurality of spaced-apart keys is formed of metal, wood, or a synthetic material.

19. The method of claim 16, wherein a length of each strike pad is at least slightly less than a length of the key to which the strike pad is attached.

20. The method of claim 16, wherein a thickness of each strike pad is less than a thickness of the key to which the strike pad is attached.

* * * * *